US005145597A

United States Patent [19]

Rodriguez et al.

[11] Patent Number: 5,145,597

[45] Date of Patent: Sep. 8, 1992

[54] CLEANING COMPOSITION AND METHOD OF USE

[75] Inventors: Manual S. Rodriguez, Houston; Nelson E. Prieto, Richmond, both of Tex.

[73] Assignee: Shell Oil Company, Houston, Tex.

[21] Appl. No.: 762,527

[22] Filed: Sep. 18, 1991

Related U.S. Application Data

[63] Continuation-in-part of Ser. No. 576,039, Aug. 31, 1990, abandoned.

[51] Int. Cl.[5] ..... C11D 1/66; C11D 3/06

[52] U.S. Cl. ..... 252/135; 252/181; 252/DIG. 5; 252/DIG. 14

[58] Field of Search ..... 252/135, DIG. 14, DIG. 5, 252/181

[56] References Cited

U.S. PATENT DOCUMENTS

| | | | |
|---|---|---|---|
| 3,951,826 | 4/1976 | Rasmussen | 252/8.9 |
| 4,496,470 | 1/1985 | Kapiloff et al. | 252/181 |
| 4,521,332 | 6/1985 | Milora | 252/527 |
| 4,539,134 | 9/1985 | Martin et al. | 252/156 |
| 4,623,483 | 11/1986 | Lamberti et al. | 252/545 |
| 4,695,396 | 9/1987 | Rossmann et al. | 252/135 |
| 4,762,638 | 8/1988 | Dollman et al. | 252/135 |
| 4,915,854 | 4/1990 | Mao et al. | 252/8.8 |
| 5,055,139 | 11/1991 | Personette | 252/135 |

*Primary Examiner*—Paul Lieberman
*Assistant Examiner*—K. Fries

[57] ABSTRACT

A cleaning composition and a method of using such composition to remove polymeric deposits on mechanical equipment used in producing or processing polymeric materials, comprises an aqueous solution of from about 1% by weight to about 12% by weight of caustic, from about 0.05% by weight to about 3% by weight of a phosphate builder, from about 0.05% by weight to about 3% by weight of a chelating agent, from about 0.1% by weight to about 6% by weight of a solubilizer and from about 1% by weight to about 7% by weight of a nonionic surfactant.

20 Claims, No Drawings

CLEANING COMPOSITION AND METHOD OF USE

This is a continuation-in-part of application Ser. No. 07/576,039 filed Aug. 31, 1990 now abandoned Jan. 24, 1992.

FIELD OF THE INVENTION

The present invention relates to alkaline cleaners useful in the cleaning of mechanical equipment. More particularly, the invention relates to a method of removing polymer residues and/or degradation products from mechanical equipment used in the production or processing of such polymers.

BACKGROUND OF THE INVENTION

It is known that the production and/or processing of many if not most polymeric materials will typically leave residues of the polymer or the degradation products thereof in or on mechanical equipment used in the production or processing of such polymers. The presence of such residues is detrimental to the continued operation of that equipment. Frequently, the presence of even small amounts of degradation products as residue promotes further degradation. An extensive build-up of residues could eventually lead to the plugging of the equipment with catastrophic results. It is necessary to periodically shut down and clean polymer producing or processing equipment in order to remove the residues and the resulting down time has considerable economic consequences.

The removal of such residues is not easily accomplished in most instances. The residues are not often soluble in common solvents and typically require rather harsh treatment for their removal. The conventional cleaning compositions are solvent-based or of the "oven cleaner" type. These compositions generally require elevated temperatures for successful operation, e.g., up to about 250° C. or higher, and will frequently emit solvent or toxic fumes at the temperature of utilization. Such fumes pose a considerable hazard for plant operators involved in cleaning operations. In addition, a substantial effort (scrubbing) is often required to effectively clean the equipment. It would be of advantage to provide cleaning compositions for such mechanical equipment which would provide effective cleaning at lower temperatures with reduced effort.

SUMMARY OF THE INVENTION

The present invention provides an improved cleaning composition for use, inter alia, in the removal of polymeric residues from mechanical equipment used in the production or processing of polymers. More particularly, the present invention provides such cleaning compositions which provide improved cleaning of such equipment at relatively low temperatures without the emission of undesirable vapors.

DESCRIPTION OF THE INVENTION

The cleaning compositions of the present invention are aqueous, alkaline mixtures of detergents, builders, chelating agents and solubilizers which are broadly known to be useful in cleaning compositions. The particular combination of components has been found, in contrast with other compositions, to be useful in the removal of polymeric residues from mechanical equipment at temperatures at or about ambient and without the emission of undesirable fumes.

The major component of the cleaning compositions of the invention is water, being present in amounts of up to about 69% to about 98% by weight, based on total cleaning composition, or even higher. The active components are present in particular quantities as discussed below, and it should be appreciated that the balance of the cleaning composition up to 100% by weight is water.

The alkaline character of the cleaning composition is provided by the presence therein of caustic. By the term "caustic" is meant any of the conventional materials used to provide alkalinity to cleaning compositions such as alkali metal hydroxide, particularly sodium hydroxide or potassium hydroxide, sodium bicarbonate, sodium carbonate, the mixed salt identified as $NaHCO_3$.-$Na_2CO_3$ and borax, e.g., $Na_4B_2O_7$. The use as caustic of an alkali metal hydroxide such as sodium hydroxide or potassium hydroxide is preferred, and particularly preferred as caustic is sodium hydroxide. The caustic is utilized in the compositions of the invention in quantities of from about 1% by weight to about 12% by weight based on total composition, particularly in quantities from about 6% by weight to about 10% by weight on the same basis.

A second component of the cleaning compositions is a phosphate builder. Such phosphate builders are typically inorganic, often alkali metal-containing, complex phosphates having one or more than one phosphorus atom in the apparent molecule. Illustrative phosphate builders include trisodium phosphate, sodium tripolyphosphate, tetrasodium pyrophosphate and tetrapotassium pyrophosphate. The compounds trisodium phosphate and tetrapotassium pyrophosphate represent a preferred class of phosphate builders. The builder is employed in the present compositions in an amount from about 0.05% by weight to about 3% by weight based on the total composition. Amounts of builder from about 0.1% by weight to about 1% by weight on the same basis are preferred.

The cleaning compositions also include a chelating agent which is often employed in cleaning compositions as an antideposition agent to retain in solution any metallic species present in the polymer residues being removed. The chelating agent has a plurality, e.g., at least two and generally three or more, of groups which are capable of bonding to or complexing with metallic species. The most frequently used chelating agents in cleaning compositions are nitrilotriacetic acid (NTA) or ethylenediamine tetraacetic acid (EDTA) and their salts although other materials containing a multiplicity of nitrogen moieties or carboxylic acid groups are also suitable. The chelating agent is employed in an amount of from about 0.05% by weight to about 3% by weight based on total composition with amounts from about 0.1% by weight to about 1% by weight on the same basis being preferred.

The compositions of the invention also include a material which, for purposes of clarity is termed a solubilizer although in other instances such materials are alternatively termed anionic surfactants. The solubilizer, intended to improve the mutual solubility of the components of the composition, is illustrated by alkali metal or ammonium salts of alkylaromatic sulfonic acids or alkali metal or ammonium salts of mono—or diesters of polyphosphoric acid or ethoxylated derivatives thereof. The counterion of the solubilizer is an alkali metal, e.g., sodium or potassium, or is ammonium ($NH_4^+$), but is preferably sodium. These cations are present in salts of alkylaromatic sulfonic acids or partial salts of partially esterified phosphoric acids. Illustrative of alkylaromatic sulfonic acids are alkylbenzene sulfonic acids such as toluenesulfonic acid, xylenesulfonic acid and cumenesulfonic acid. Also useful are partial salts of partial esters of phosphorus acids, including ethoxylated phosphorus acids, of the formula $$X_{n+2}P_nO_{3n+1}$$

wherein X is alkali metal or ammonium, R or $R\text{-}(O\text{—}CH_2\text{—}CH_2)_x$ wherein R is alkyl of up to 18 carbon atoms and x is average number from 1 to about 12, or mixtures thereof. The solubilizer is provided to the compositions of the invention in an amount as required for clarity, e.g., an amount from about 0.1% by weight to about 6% by weight based on total composition. Amounts of solubilizer from about 0.5% by weight to about 3% by weight on the same basis are preferred.

The cleaning compositions also include a nonionic surfactant as is illustrated by long chain ($C_8$–$C_{24}$) alcohols and ethoxylated derivatives thereof, alkyl phenols and ethoxylated derivatives thereof, glycol esters of long-chain carboxylic acids including carboxylic acids obtained from natural fats and oils, carboxylic acid amides and glycerol monoesters of long-chain fatty acids. The preferred nonionic surfactants are ethoxylated alcohols or alkylphenols represented by the formula $$R''\text{-}(O\text{—}CH_2\text{—}CH_2)_yOH \qquad \text{(II)}$$

wherein R'' is alkyl of from about 8 to about 24 carbon atoms inclusive, preferably from 9 to 16 carbon atoms inclusive, or alkylphenyl wherein the alkyl moiety has from about 8 to about 12 carbon atoms inclusive, and y is an average number from 1 to about 12. Such materials are well known and commercial, being marketed by a number of U.S. and foreign detergent manufacturers. The nonionic surfactant is employed in a quantity from about 1% by weight to about 7% by weight based on total composition. Amounts from about 2% by weight to about 7% by weight on the same basis are preferred.

As previously stated, the active components of the cleaning composition are employed in aqueous solution with the balance up to 100% by weight being water. Such aqueous-based cleaning compositions are known and conventional but are not often used for removal of organic polymeric residues from mechanical equipment. For a more extensive discussion of cleaning compositions and components of the above types see Kirk-Othmer, Encyclopedia of Chemical Technology, Third Edition, Vol. 22, Pages 360 et seq., incorporated herein by reference.

The cleaning compositions are utilized to remove polymeric residues from mechanical equipment used to produce or process the polymer precursors of the residues. Illustrative of polymers whose residues or residues of polymeric decomposition products thereof are effectively removed by use of the present cleaning compositions are polypropylene, polybutene, block polymers of vinyl aromatic compounds (styrene) and conjugated alkadienes and particularly the linear alternating polymers of carbon monoxide and at least one ethylenically unsaturated hydrocarbon known as polyketones. The efficacy of the composition lies in the particular combination of components rather than the use of one or more of the individual components, each of which is known to be useful in cleaning compositions. The compositions of the invention effectively remove polymeric residues at or about ambient (room) temperature with a minimum of cleaning effort. In one modification polymerization equipment such as a polymerization reactor is filled with a composition of the invention and allowed to stand until the polymeric residues are more easily removed. In an alternate modification, a mechanical part such as an extruder screw is allowed to soak in the composition. The subsequent removal of polymer residues or degredation products in more easily accomplished.

The invention is further illustrated by the following Illustrative Embodiment which should not be regarded as limiting.

Illustrative Embodiment

An extruder screw of 2 inches in diameter was removed from an extruder used to process a linear alternating terpolymer of carbon monoxide, ethylene and propylene. The screw was found to have polymeric deposits of polymer an polymer decomposition product. Using a commercial cleaner marketed for the removal of polymeric residues, a time of up to two hours of continuous cleaning effort was required to remove the residues.

An extruder screw also having polymeric residues from processing the linear alternating terpolymer was allowed to soak for 4 hours in an aqueous solution 8% in sodium hydroxide and containing 3% by weight of NEODOL ® 25-7 Detergent Alcohol Ethoxylate marketed by Shell Chemical Company, 1% by weight of the potassium salt of a phosphate ester hydrotrope, 0.5% by weight sodium ethylenediamine tetraacetic acid and 0.5% by weight tetrapotassium pyrophosphate. After the period of soak, less than 10 minutes of spot cleaning and rinsing were required to clean the extruder screw.

What is claimed is:

1. An aqueous cleaning solution consisting essentially of:

a) from about 1% by weight to about 12% by weight of caustic based on total solution;
b) from about 0.1% by weight to about 1% by weight of phosphate builder on total solution;
c) from about 0.05% by weight to about 3% by weight of chelating agent based on total solution;
d) from about 0.1% by weight to about 6% by weight of solubilizer based on total solution;
e) from about 1% by weight to about 7% by weight of nonionic surfactant based on total solution; and
f) the balance of the total solution being water to 100%.

2. The solution of claim 1 wherein the caustic is sodium hydroxide or potassium hydroxide.

3. The solution of claim 2 wherein the chelating agent is selected from the group consisting of nitrilotriacetic acid, ethylenediamine tetraacetic acid and salts of said acids.

4. The solution of claim 3 wherein the builder is trisodium phosphate or tetrapotassium pyrophosphate.

5. The solution of claim 4 wherein the nonionic surfactant is an ethoxylated alcohol or an ethoxylated alkylphenol.

6. An aqueous cleaning solution consisting essentially of:

a) from about 6% by weight to about 10% by weight of caustic based on the total solution;
b) from about 0.1% by weight to about 1% by weight of phosphate builder based on total solution;
c) from about 0.5% by weight to about 3% by weight of solubilizer based on total solution;
d) from about 0.1% by weight to about 1% by weight of chelating agent based on total solution;
e) from about 2% by weight to about 7% by weight of nonionic surfactant based on total solution; and
f) the balance of the total solution being water to 100%.

7. The composition of claim 6 wherein the phosphate builder is sodium phosphate or tetrapotassium pyrophosphate.

8. The solution of claim 7 wherein the caustic is sodium hydroxide or potassium hydroxide.

9. The solution of claim 8 wherein the chelating agent is selected from the group consisting of nitrilotriacetic acid, ethylenediamine tetracetic acid and the salts of said acids.

10. The solution of claim 9 wherein the nonionic surfactant is an ethoxylated alcohol or an ethoxylated alkylphenol.

11. The solution of claim 10 wherein
(a) the solubilizer is an
i) alkali metal or ammonium salt of alkylbenzenesulfonic acid or
ii) partial salt of partially estified phosphoric acid of the formula $$X_{n+2}P_nO_{3n+1}$$

wherein X is alkali metal, ammonium, R or R—(O—$CH_2CH_2$—) y—wherein R is alkyl of up to 18 carbon atoms and x is an average number from 1 to about 12 inclusive, or mixtures thereof, and
(b) the nonionic surfactant is of the formula $$R''—(OCH_2CH_2—)—OH$$

wherein R" is alkyl of from about 8 to about 24 carbon atoms inclusive or alkylphenyl wherein the alkyl moiety has from about 8 to about 12 carbon atoms and y is an average number from 1 to about 12.

12. The method of removing polymeric residues from mechanical equipment used in the production or processing of polymers, which comprises soaking said equipment at ambient temperatures in an aqueous cleaning solution consisting essentially of:
a) from about 1% by weight to about 12% by weight of caustic based on total solution;
b) from about 0.1% by weight to about 1% by weight of phosphate builder based on total solution;
c) from about 0.05% by weight to about 3% by weight of chelating agent based on total solution;
d) from about 0.1% by weight to about 6% by weight of solubilizer based on total solution;
e) from about 1% by weight to about 7% by weight of nonionic surfactant based on total solution; and
f) the balance of the total solution being water to 100%.

13. The method of claim 12 wherein the caustic is sodium hydroxide or potassium hydroxide.

14. The method of claim 13 wherein the chelating agent is selected from the group consisting of nitrilotriacetic acid or ethylenediamine tetraacetic acid or the salts of said acids.

15. The method of claim 14 wherein the builder is trisodium phosphate or tetrapotassium pyrophosphate.

16. The method of claim 15 wherein the nonionic surfactant is an ethoxylated alcohol or an ethoxylated alkylphenol.

17. The method of claim 12, wherein said aqueous cleaning solution consist essentially of:
a) from about 6% by weight to about 10% by weight of caustic based on total solution;
b) from about 0.1% by weight to about 1% by weight of phosphate builder based on total solution;
c) from about 0.1% by weight to about 1% by weight of chelating agent based on total solution;
d) from about 0.5% by weight to about 3% by weight of solubilizer based on total solution;
e) from about 2% by weight to about 7% by weight of nonionic surfactant based on total solution; and
f) the balance of the total solution being water to 100%.

18. The method of claim 17, wherein the caustic is sodium hydroxide or potassium hydroxide and the phosphate builder is sodium phosphate or tetrapotassium phyrophosphate.

19. The method of claim 18, wherein the chelating agent is selected from the group consisting of nitrilotriacetic acid, ethylenediamine tetracetic acid and the salts of said acids.

20. The method of claim 19, wherein
(a) the solubilizer is an
i) alkali metal or ammonium salt of alkylbenzenesulfonic acid, or
ii) partial salt of partially esterified phosphoric acid of the formula $$X_{n+2}P_nO_{3n+1}$$

wherein X is alkali metal, ammonium, R or R—(O—$CH_2CH_2$)$_y$— wherein R is allyl of up to 18 carbon atoms and x is an average number from 1 to about 12 inclusive, or mixtures thereof, and
(b) the nonionic surfactant is of the formula $$R''—(OCH_2CH_2—)_y—OH$$

wherein R" is alkyl of from about 8 to about 24 carbon atoms inclusive or alkylphenyl wherein the alkyl moiety has from about 8 to about 12 carbon atoms and y is an average number from 1 to about 12.

* * * * *